US009776371B2

(12) United States Patent
Watanabe et al.

(10) Patent No.: US 9,776,371 B2
(45) Date of Patent: Oct. 3, 2017

(54) SCORING MACHINE

(71) Applicant: Horizon International Inc., Shiga (JP)

(72) Inventors: Shinya Watanabe, Shiga (JP); Tatsuaki Ida, Shiga (JP)

(73) Assignee: Horizon International Inc., Shiga (JP)

( * ) Notice: Subject to any disclaimer, the term of this patent is extended or adjusted under 35 U.S.C. 154(b) by 468 days.

(21) Appl. No.: 14/597,281

(22) Filed: Jan. 15, 2015

(65) Prior Publication Data

US 2015/0231847 A1 Aug. 20, 2015

(30) Foreign Application Priority Data

Feb. 17, 2014 (JP) ..... 2014-027361

(51) Int. Cl.
*B31F 1/00* (2006.01)

(52) U.S. Cl.
CPC ..... *B31F 1/0025* (2013.01)

(58) Field of Classification Search
CPC ..... B31F 1/0025; B65H 45/30
USPC ..... 493/79, 127, 59, 68–69
See application file for complete search history.

(56) References Cited

U.S. PATENT DOCUMENTS 1,714,715 A 5/1929 Gooding

FOREIGN PATENT DOCUMENTS

JP 2011-152982 8/2011
JP 2011152982 A * 8/2011

* cited by examiner

*Primary Examiner* — Stephen F Gerrity
*Assistant Examiner* — Jeffrey T Ice
(74) *Attorney, Agent, or Firm* — Kirschstein, Israel, Schiffmiller & Pieroni, P.C.

(57) ABSTRACT

A scoring machine incorporated in a sheet folding apparatus forms scores on sheets according to a folding pattern. The scoring machine comprises upper and lower rotary shafts provided with pairs of convex and concave rollers, and a positioning unit slidably attached to a slide guide. When a rotatable member is arranged at a standing position, the convex roller engages with a groove on one end face of the rotatable member, or the concave roller engages with a projection on the other end face of the rotatable member. A sequence pattern of the pairs of convex and concave rollers on the upper and lower rotary shafts corresponding to the folding pattern is displayed on a display. The positioning unit stops at the specified positions of the pairs of convex and concave rollers while sliding.

3 Claims, 6 Drawing Sheets

SCORING MACHINE

TECHNICAL FIELD

The present invention relates to a scoring machine incorporated in a buckle-type sheet folding apparatus so as to form a score or scores on sheets according to a folding pattern achieved by the sheet folding apparatus.

BACKGROUND ART

The buckle-type sheet folding apparatus has a plurality of buckles into which sheets to be folded are inserted by a length corresponding to a predetermined folding position. In each of the buckles, a stopper whose position is adjustable is arranged so that the sheet is stopped by colliding its leading end with the stopper so as to be set at the folding position. At an inlet of each of the buckles, a pair of driven intake rollers is arranged opposite to each other so as to take the sheet into the associated buckle and a pair of driven discharge rollers is arranged opposite to each other so as to fold a portion of the sheet deflected from the associated buckle outward.

Then the sheet is fed to the buckle-type sheet folding apparatus along a sheet feed path and nipped between the pair of driven intake rollers at the inlet of the first buckle and taken into the first buckle. When the leading end of the sheet collides with the stopper of the first buckle, the sheet deflects from the first buckle outward in the neighborhood of the inlet of the first buckle and the outward deflected portion of the sheet is nipped between the pair of the discharge rollers so as to be folded.

When the sheet is further folded, the folded sheet is inserted into the second buckle with its fold line in the lead by the pair of driven intake rollers at the inlet of the second buckle. When the leading end of the folded sheet collides with the stopper of the second buckle, the folded sheet deflects from the second buckle outward in the neighborhood of the inlet of the second buckle and the outward deflected portion of the sheet is nipped between the pair of discharge rollers of the second buckle so as to be further folded. The sheet is similarly folded predetermined number of times and finally the folded sheet is discharged from the sheet folding apparatus.

Thus, according to one buckle-type sheet folding apparatus, sheets are folded up in a direction perpendicular to a sheet feed direction according to a predetermined folding pattern (consisting of only at least one mountain fold, only at least one valley fold or a combination of mountain and valley folds) so that an accordion-folded sheets can be produced, and, in some cases, in order to further fold the accordion-folded sheets in a direction perpendicular to the folding lines, two buckle-type sheet folding apparatuses are perpendicularly connected to each other.

In such cases, the sheets increase their thickness and stiffness by being folded like an accordion by the first (upstream) buckle-type sheet folding apparatus and, if the accordion-folded sheets are directly fed from the first buckle-type sheet folding apparatus to the second (downstream) buckle-type sheet folding apparatus, the misalignment of folding lines and dull folding lines and so on are possibly caused. Therefore, in the prior art, the first sheet folding apparatus is provided with a scoring machine which forms a score or scores on the folded sheets outputted from the first buckle-type sheet folding apparatus according to a folding pattern achieved by the second buckle-type sheet folding apparatus.

An example of conventional scoring machines is disclosed in JP 2011-152982 A1. The scoring machine disclosed in JP 2011-152982 A1 comprises horizontal upper and lower rotary shafts, a plurality of first rollers mounted on the upper rotary shaft, and a plurality of second rollers mounted on the lower rotary shaft in a manner such that the second rollers are paired with the first rollers. Each of the first and second rollers is provided with a stop screw and fixed to the desired position by screwing the stop screw. The respective paired first and second rollers are arranged opposite to each other, and one of the respective paired first and second rollers is a convex roller having an annular projection at outer periphery thereof and the other of the respective paired first and second rollers is a concave roller having an annular groove at outer periphery thereof.

A guide rod is attached to a frame at its both ends and extends parallel to the upper rotary shaft above the upper rotary shaft and a guide rod is attached to the frame at its both ends and extends parallel to the lower rotary shaft below the lower rotary shaft. A slider is slidably attached to a pair of the guide rods. In addition, a stepping motor and an encoder are arranged in the neighborhood of the both ends of the guide rods, and a timing belt extends between rotary shafts of the stepping motor and encoder through pulleys. The slider is fixed to the timing belt and slides with the circulation of the timing belt.

A sensor for detection of the annular projections of the concave rollers as swell as a positioning gauge for positioning of the annular projections of the concave rollers are fixed to each of the upper and lower portions of the slider. In this case, the upper sensor and positioning gauge are provided exclusively for the convex rollers of the upper rotary shaft and the lower sensor and positioning gauge are provided exclusively for the convex rollers of the lower rotary shaft.

Thus the information of a folding pattern achieved by the second folding apparatus is inputted by an operator to a control unit of the scoring machine and a combination of the first and second rollers as well as an array of each pair of the first and second rollers on the upper and lower rotary shafts corresponding to the folding pattern is displayed on a display of the control unit. Then the operator mounts the first and second rollers on the upper and lower rotary shafts according to the array displayed on the display and attaches the upper and lower rotary shafts to the frame of the scoring machine.

Next, the slider slides along the pair of the guide rods while the upper and lower sensors detect the current positions of the annular projections of the convex rollers of the upper and lower rotary shafts. Then the slider (gauges) slides to the specified position of each convex roller according to the order of selection of the convex rollers based on the information of both the current positions and the specified positions of the convex rollers. Whenever the slider (gauge) stops at the specified position of the convex roller, the associated convex roller is positioned and fixed by hand in such a manner that the position of the annular projection thereof corresponds to the gauge, and then the associated concave roller is positioned and fixed in such a manner that the annular groove thereof engages with the annular projection of the convex roller.

Thereafter a sheet to be fed to the buckle-type sheet folding apparatus is inserted between the pairs of first and second rollers and the first and second rollers are rotated by hand so as to form a score or scores on the sheet, and thereby it is checked whether the score or scores formed on the sheet agree with the folding pattern or not, and the position setting of the first and second rollers are preformed again depending on the result of the checking.

By the way, in normal folding patterns, the convex rollers are necessarily mounted on both the upper and lower shafts so that the scoring machine needs the sensor and gauge for the convex rollers of the upper rotary shaft and the sensor and gauge for the convex rollers of the lower rotary shaft. Consequently, the scoring machine has a defect that its size becomes bigger and its structure is complicated. Therefore, in the prior art, it was necessary to arrange the structure for positioning the upper and lower rollers of the scoring machine (the slider and the mechanism for guide and drive of the slider) outside the buckle-type sheet folding apparatus as a unit separate to the buckle-type sheet folding apparatus.

SUMMARY OF THE INVENTION

Problems to be Solved by the Invention

It is, therefore, an object of the present invention to provide a scoring machine which has a simple structure and facilitates the quick and precise setting of rollers thereof.

Means for Solving the Problems

In order to achieve this object, the present invention provides a scoring machine incorporated in a buckle-type sheet folding apparatus so as to form a score or scores on sheets according to a folding pattern to be achieved by the sheet folding apparatus, the scoring machine comprising: a frame; upper and lower rotary shafts extending parallel with and at a distance from each other and supported by the frame to rotate about axes thereof; a plurality of first rollers mounted on the upper rotary shaft; a plurality of second rollers mounted on the lower rotary shaft, the first and second rollers being paired, wherein each of the first and second rollers is provided with a stop screw so that the first and second rollers are fixed to the desired position on the upper and second rotary shafts, respectively by screwing the stop screw, and the respective paired first and second rollers are arranged opposite to each other, and one of the respective paired first and second rollers is a convex roller having an annular projection at outer periphery thereof and the other of the respective paired first and second rollers is a concave roller having an annular groove at outer periphery thereof; a first drive mechanism attached to the frame so as to rotate the upper and lower rotary shafts in synchronization with each other, the score or scores being formed on the sheets while the sheets are passed between the respective paired first and second rollers; a slide guide attached to the frame and extending parallel to the upper and lower rotary shafts right above the upper rotary shaft or right below the lower rotary shaft; a single positioning unit slidably attached to the slide guide; a second drive mechanism attached to the frame so as to move the positioning unit; a control unit controlling the second drive mechanism; a distance measurement unit measuring a travel distance of the positioning unit from a reference point on the slide guide; and a display, wherein the positioning unit comprises: a slider slidably attached to the slide guide; a rotatable member attached to the slider so as to rotate about an axis of the slide guide between a lying position at which the rotatable member horizontally extends in a diametrical direction of the slide guide and a standing position at which the rotatable member is rotated from the lying position by 90° clockwise and counterclockwise; and a resilient biasing member arranged between the slider and the rotatable member so as to constantly bias the rotatable member toward the lying position, the rotatable member being manually rotated from the lying position to the standing position, wherein the rotatable member has longitudinal end faces each of which is in the form of circular arc centered at the axis of the slide guide as viewed in an axial direction of the slide guide, one of the longitudinal end faces having a groove corresponding to the annular projection of the convex roller and the other of the longitudinal end faces having a projection corresponding to the annular groove of the concave roller, wherein when the rotatable member is arranged at the lying position, the positioning unit is spaced from the first or second roller of the closest rotary shaft of the upper and lower rotary shafts, and when the rotatable member is arranged at the standing position, the rotatable member is engaged with the annular projection of the convex roller of the closest rotary shaft at the groove of the longitudinal end face thereof or with the annular groove of the concave roller of the closest rotary shaft at the projection of the longitudinal end face thereof, wherein the control unit displays on the display a combination of the first and second rollers as well as an array of each pair of the first and second rollers on the upper and lower rotary shafts corresponding to the folding pattern, and slides the positioning unit while stopping the positioning unit at the specified positions of the pairs of the first and second rollers based on the measurement value of the distance measurement unit.

According to a preferred embodiment of the present invention, the slider of the positioning unit comprises: a horizontal cylindrical portion; a pair of vertical wall portions composed of plates provided with circular openings adapted to the outside diameter of the cylindrical portion and fixed to both ends of the cylindrical portion with the cylindrical portion passing through the circular openings; and a connecting portion extending between the wall portions at a distance from the axis of the cylindrical portion, the distance being larger than a half of the longitudinal length of the rotatable member, and the slider is fitted on the slide guide with the slide guide passing through the cylindrical portion, wherein the rotatable member is composed of a rectangular plate having a given amount of thickness and a central circular opening which corresponds to the outside diameter of the cylindrical portion of the slider, and fitted on the slider with the cylindrical portion passing through the central circular opening, wherein the resilient biasing member is composed of a pair of torsion springs encircling the cylindrical portion between each of the wall portions of the slider and the rotatable member, and the pair of torsion springs is arranged in such a way that directions of twisting thereof match each other, and each of the torsion springs is fixed to the associated wall portion at one end thereof and the other end of each of the torsion springs becomes a free end, and the rotatable member has pins engageable with the free ends of the associated torsion springs at side surfaces thereof opposed to the wall portions, wherein when the rotatable member is arranged at the lying position, the pins of the rotatable member presses the free ends of the associated torsion springs in the direction of twisting so that the pair of torsion springs are twisted by a certain amount in the direction of twisting so as to balance between the clockwise and counterclockwise rotational moments of the rotatable member, and when the rotatable member is arranged at the standing position, one of the pins of the rotatable member moves away from the free end of the associated torsion spring and the other of the pins of the rotatable member further presses the free end of the associated torsion spring in the direction of twisting.

According to another preferred embodiment of the present invention, the second drive mechanism comprises: a pair of pulleys arranged at both ends of the slide guide and rotatably attached to the frame; a timing belt extending between the pair of pulleys and parallel to the slide guide; and a motor attached to the frame and coupled to a rotary shaft of one of the pair of pulleys, and the distance measurement unit comprises: a rotary encoder attached to a rotary shaft of one of the pair of pulleys; a counter of the control unit counting pulse signals outputted from the rotary encoder; and a distance calculation section of the control unit calculating a distance based on the count value of the counter.

Effect of the Invention

According to the present invention, at the start of working, an operator mounts the first and second rollers on the upper and lower rotary shafts according to the array displayed on the display and attaches the upper and lower rotary shafts to the frame of the scoring machine. Thereafter, whenever the slider stops, the operator only has to manually rotate the rotatable member from the lying position to the standing position in a manner such that the associated longitudinal end face thereof faces upward depending on whether a roller to be positioned is the convex roller or the concave roller, and position the associated roller by engaging the associated roller with the rotatable member, and fix the associated roller to one rotary shaft, and then position the roller paired with the fixed roller by engaging the paired rollers, and fixe the roller paired with the fixed roller to the other rotary shaft. Therefore the positioning of each of the first and second rollers is achieved easily and in a short time.

In addition, according to the present invention, the positioning of all of the rollers (convex and concave rollers) on one of the upper and lower rotary shafts is done by using a single positioning unit and therefore, a mechanism for positioning of the rollers, that is, the scoring machine can be simplified and downsized. Thereby the whole of the scoring machine can be incorporated into a buckle-type sheet folding apparatus so that the downsizing of the buckle-type sheet folding apparatus is achieved.

BEST MODE FOR CARRYING OUT THE INVENTION

Figure 1:
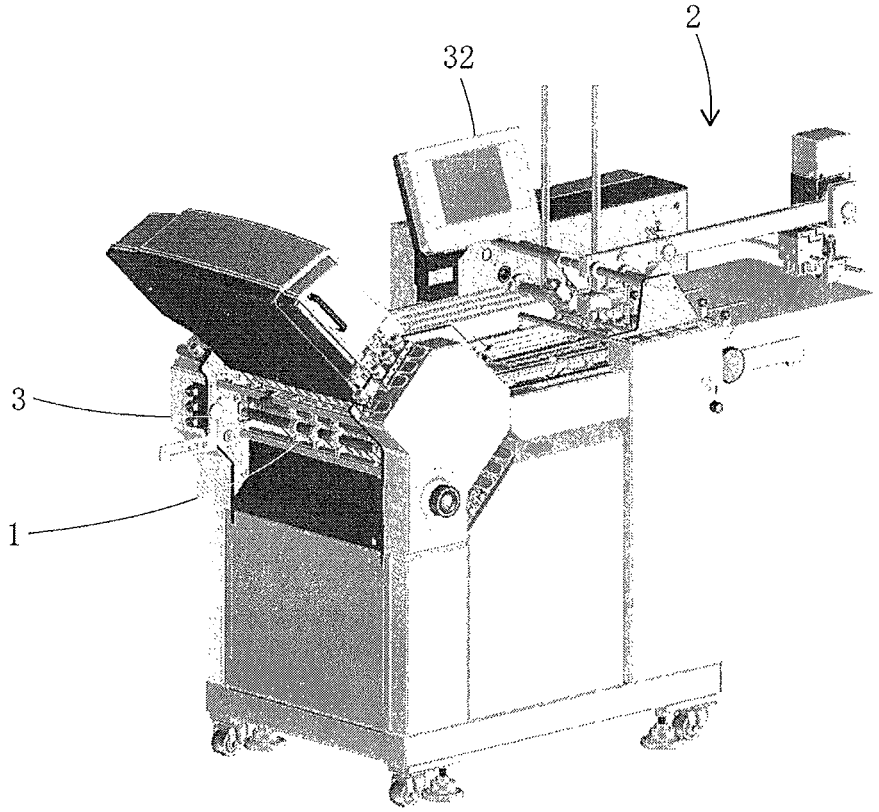
FIG. 1 is a perspective view of a buckle-type sheet folding apparatus in which a scoring machine according to an embodiment of the present invention is incorporated.

A preferred embodiment of the present invention will be explained below with reference to accompanying drawings. In this embodiment, as shown in FIG. 1, a scoring machine 1 according to the present invention is incorporated in a sheet outlet 3 of a buckle-type sheet folding apparatus 2. Although not shown in FIG. 1, another buckle-type sheet folding apparatus is connected to the sheet outlet 3 of the buckle-type sheet folding apparatus 2 so as to be arranged perpendicularly to a sheet ejecting direction of the buckle-type sheet folding apparatus 2. Then the sheet folded by the buckle-type sheet folding apparatus 2 is further folded by the downstream buckle-type sheet folding apparatus in a predetermined folding pattern perpendicularly to the direction of folds provided by the buckle-type sheet folding apparatus 2.

Figure 2:
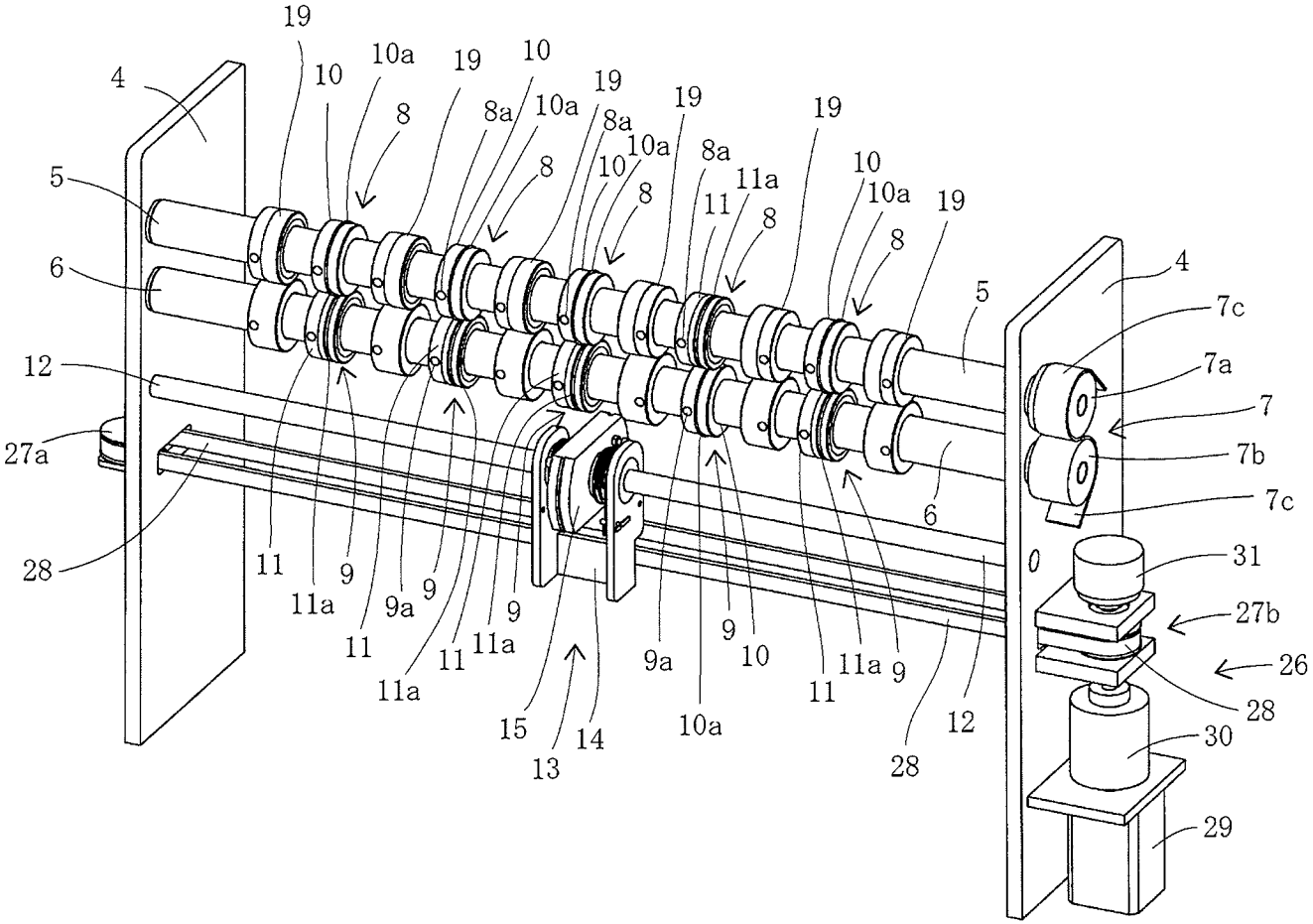
FIG. 2 is a schematic perspective view of the scoring machine shown in FIG. 1.

FIG. 2 is a schematic perspective view of the scoring machine shown in FIG. 1. Referring to FIG. 2, the scoring machine 1 has a frame 4. Horizontal upper and lower rotary shafts 5, 6 are supported by the frame 4 to rotate about axes thereof and extend perpendicularly to the sheet ejecting direction of the buckle-type sheet folding apparatus 2 and parallel with and at a distance from each other.

A plurality of first rollers 8 are mounted on the upper rotary shaft 5, and a plurality of second rollers 9 are mounted on the lower rotary shaft 6. The first and second rollers 8, 9 are paired. Each of the first and second rollers 8, 9 is provided with a stop screw 8*a*, 9*a* so that the first and second rollers 8, 9 are fixed to the desired position on the upper and lower rotary shafts 5, 6, respectively by screwing the stop screw 8*a*, 9*a*. The respective paired first and second rollers 8, 9 are arranged opposite to each other, and one of the respective paired first and second rollers 8, 9 is a convex roller 10 having an annular projection 10*a* at outer periphery thereof and the other of the respective paired first and second rollers is a concave roller 11 having an annular groove 11*a* at outer periphery thereof.

In this embodiment, feed roller pairs 19 are additionally mounted on the upper and lower rotary shafts 5, 6 between the first and second roller pairs and outside the outermost first and second roller pairs so as to stabilize the sheet feed. These feed roller pairs 19 are provided as needed.

The upper and lower rotary shafts 5, 6 are rotated by a first drive mechanism 7 attached to the frame 4 in synchronization with each other. The first drive mechanism 7 is composed of pulleys 7*a*, 7*b* mounted on one end of the respective upper and lower rotary shafts 5, 6 so as to be vertically opposed to each other, a motor (not shown) attached to the frame 4, a pulley (not shown) mounted on a drive shaft of this motor, and a belt 7*c* extending between the pulleys 7*a*, 7*b* and the pulley mounted on the drive shaft.

Thus the belt 7*c* is circulated by the motor and thereby the upper and lower rotary shafts 5, 6 are rotated in a direction that sheets are ejected from the sheet outlet 3 of the buckle-type sheet folding apparatus 2, so that a score or scores are formed on the sheets while the sheets are passed between the respective paired first and second rollers 8, 9.

The scoring machine 1 further has a slide guide 12 attached to the frame 4 and extending parallel to the upper and lower rotary shafts 5, 6 right above the upper rotary shaft 5 or right below the lower rotary shaft 6 (in this embodiment, right below the lower rotary shaft 6), and a single positioning unit 13 slidably attached to the slide guide 12.

Figure 3C:
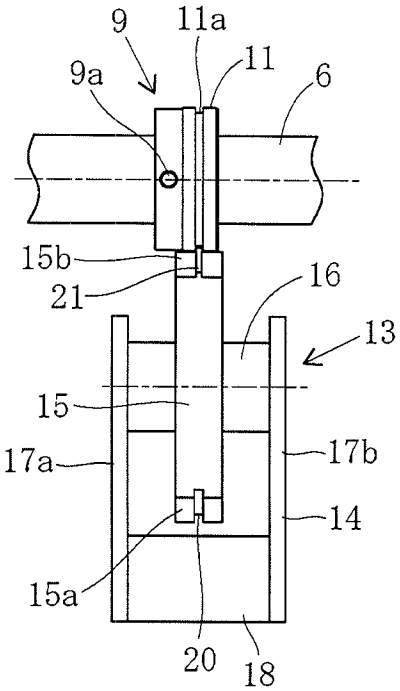
FIG. 3C is an elevational view of a positioning unit of the scoring machine shown in FIG. 2, in which a rotatable member is arranged at a standing position for positioning of a concave roller.
Figure 3B:
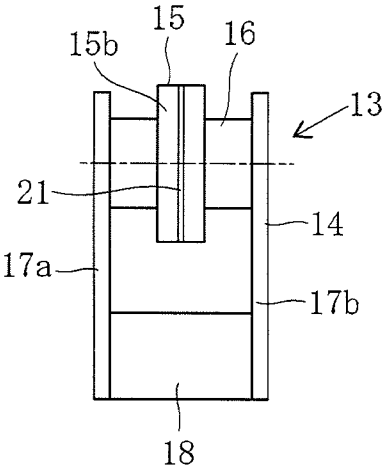
FIG. 3B is an elevational view of a positioning unit of the scoring machine shown in FIG. 2, in which a rotatable member is arranged at a lying position.
Figure 3A:
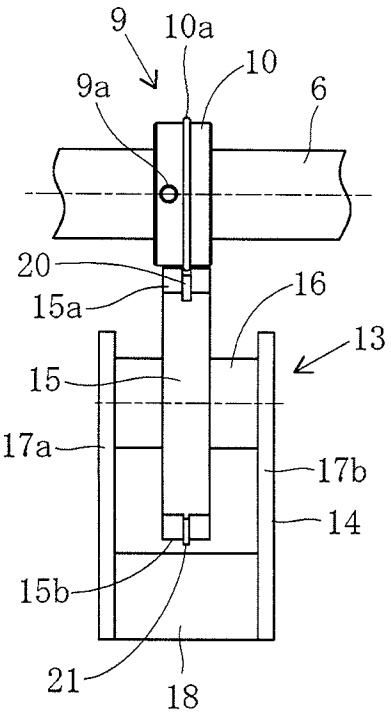
FIG. 3A is an elevation view of a positioning unit of the scoring machine shown in FIG. 2, in which a rotatable member is arranged at a standing position for positioning of a convex roller.

FIGS. 3A-3C are elevation views illustrating the operation of the positioning unit 13, and FIGS. 4A-4C and 5A-5C are perspective views illustrating the operation of the positioning unit 13. Referring to FIGS. 3A-3C, 4A-4C and 5A-5C, the positioning unit 13 has a slider 14 slidably attached to the slide guide 12, and a rotatable member 15 attached to the slider 14 so as to rotate about an axis of the slide guide 12 between a lying position (see also, FIGS. 3B, 4B and 5B) at which the rotatable member 15 horizontally extends in a diametrical direction of the slide guide 12 and a standing position (see also, FIGS. 3A, 3C, 4A, 4C, 5A and 5C) at which the rotatable member 15 is rotated from the lying position by 90° clockwise and counterclockwise.

In this embodiment, the slider 14 has a horizontal cylindrical portion 16, a pair of vertical wall portions 17*a*, 17*b* composed of plates provided with circular openings adapted to the outside diameter of the cylindrical portion 16 and fixed to both ends of the cylindrical portion 16 with the cylindrical portion 16 passing through the circular openings, and a connecting portion 18 extending between the wall portions 17*a*, 17*b* at a distance from the axis of the cylindrical portion 15, the distance being larger than a half of the longitudinal length of the rotatable member 15. The slider 14 is fitted on the slide guide 12 with the slide guide 12 passing through the cylindrical portion 16.

In this embodiment, the rotatable member 15 is in the form of a rectangular plate having a given amount of thickness and a central circular opening whose inner diameter corresponds to the outer diameter of the cylindrical portion 16 of the slider 14, and rotatably attached to the slider 14 with the cylindrical portion 16 passing through the central circular opening of the rotatable member 15.

The rotatable member 15 has longitudinal end faces 15*a*, 15*b* each of which is in the form of circular arc centered at the axis of the slide guide as viewed in an axial direction of the slide guide, one 15*a* of the longitudinal end faces 15*a*, 15*b* having a groove 20 corresponding to the annular projection 10*a* of the convex roller 10 and the other 15*b* of the longitudinal end faces 15*a*, 15*b* having a projection 21 corresponding to the annular groove 11*a* of the concave roller 11.

Figures 4A, 4B, 4C:
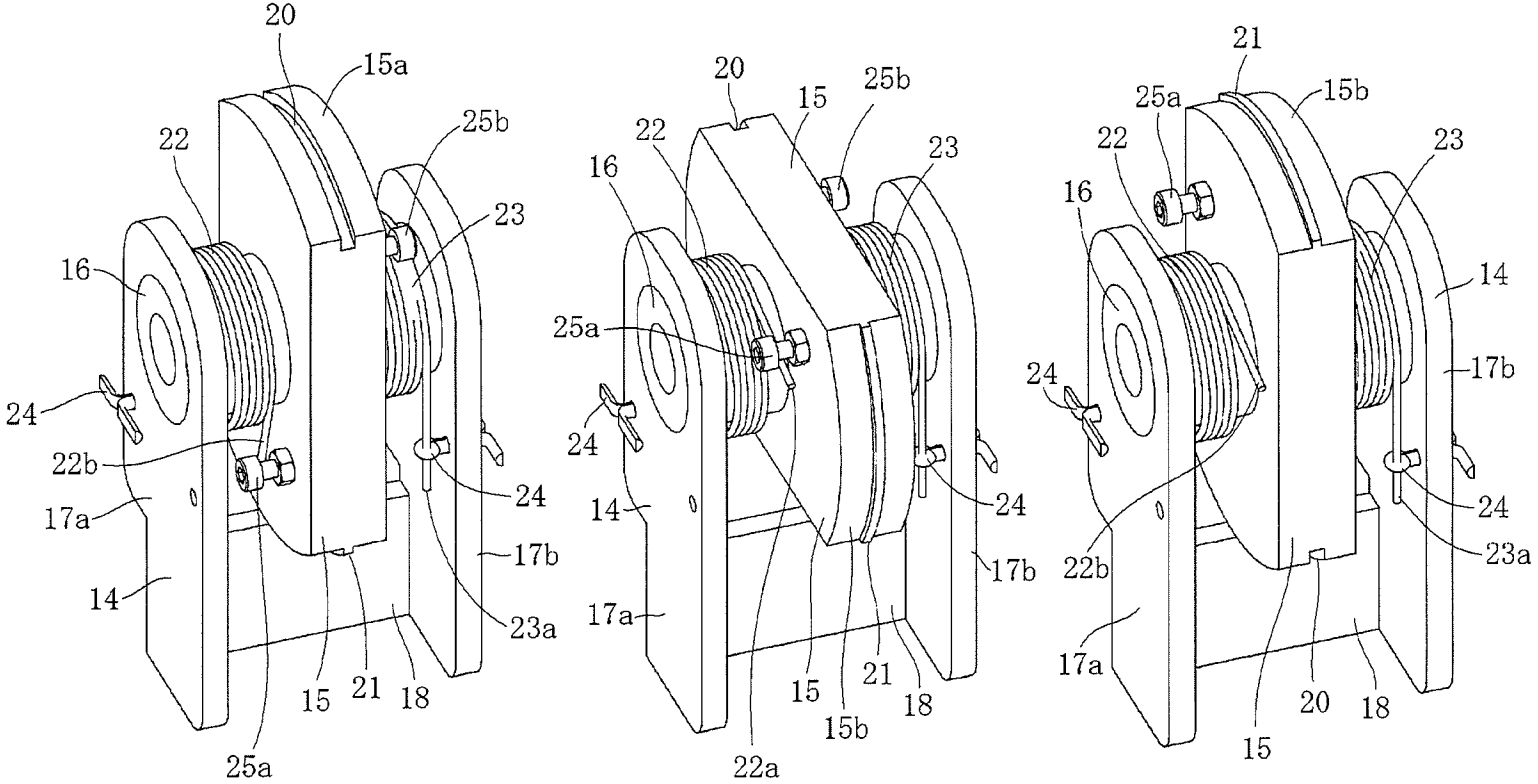
FIG. 4A is a perspective view of a positioning unit of the scoring machine shown in FIG. 2, in which a rotatable member is arranged at a standing position for positioning of a convex roller.
FIG. 4B is a perspective view of a positioning unit of the scoring machine shown in FIG. 2, in which a rotatable member is arranged at a lying position.
FIG. 4C is a perspective view of a positioning unit of the scoring machine shown in FIG. 2, in which a rotatable member is arranged at a standing position for positioning of a concave roller.
Figure 5C:
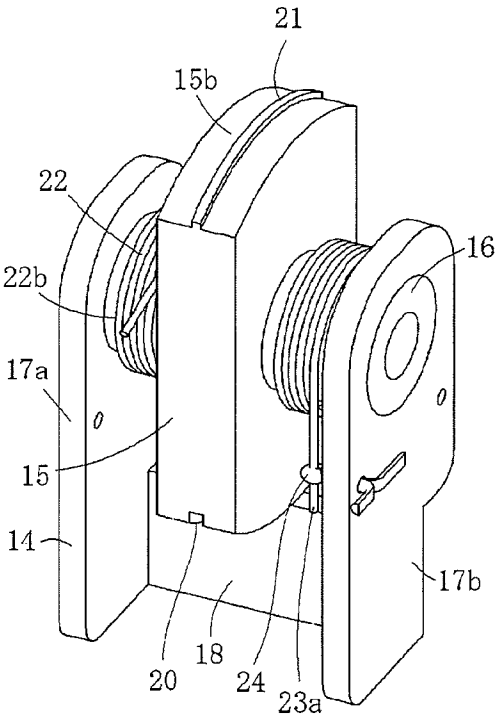
FIGS. 5A-5C are perspective views similar to FIGS. 4A-4C, respectively.

Then when the rotatable member 15 is arranged at the lying position (also see, FIGS. 3B, 4B and 5B), the positioning unit 13 is spaced from the second roller 9 of the lower rotary shaft 6 (the roller of the closest rotary shaft of the upper and lower rotary shafts 5, 6), and when the rotatable member 15 is arranged at the standing position, the rotatable member 15 is engaged with the annular projection 10*a* of the convex roller 10 of the lower rotary shaft 6 (the closest rotary shaft) at the groove 20 of the longitudinal end face 15*a* thereof (also see, FIGS. 3A, 4A and 5A) or with the annular groove 11*a* of the concave roller 11 of the lower rotary shaft 6 (the closest rotary shaft) at the projection 21 of the longitudinal end face 15*b* thereof (also see, FIGS. 3C, 4C and 5C).

A resilient biasing member is arranged between the slider 14 and the rotatable member 15 so as to constantly bias the rotatable member 15 toward the lying position. In this embodiment, the resilient biasing member is composed of a pair of torsion springs 22, 23 encircling the cylindrical portion 16 between each of the wall portions 17*a*, 17*b* of the slider 14 and the rotatable member 15. The pair of torsion springs 22, 23 is arranged in such a way that directions of twisting thereof match each other, and each of the torsion springs 22, 23 is fixed to the associated wall portion 17*a*, 17*b* by a split pin 24 at one end thereof 22*a*, 23*a* and the other end 22*b*, 23*b* of each of the torsion spring 22, 23 becomes a free end.

Figure 5B:
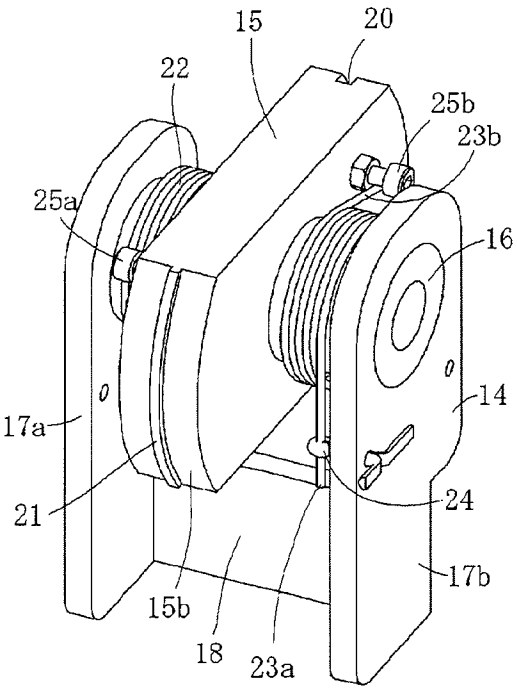

The rotatable member 15 has pins 25*a*, 25*b* engageable with the free ends 22*b*, 23*b* of the associated torsion springs 22, 23 at side surfaces thereof opposed to the wall portions 17*a*, 17*b* of the slider 14. Then, as shown in FIGS. 4B and 5B, when the rotatable member 15 is arranged at the lying position, the pins 25*a*, 25*b* of the rotatable member 15 press the free ends 22*b*, 23*b* of the associated torsion springs 22, 23 in the direction of twisting so that the pair of torsion springs 22, 23 are twisted by a certain amount in the direction of twisting so as to balance between the clockwise and counterclockwise rotational moments of the rotatable member 15.

Figure 5A:
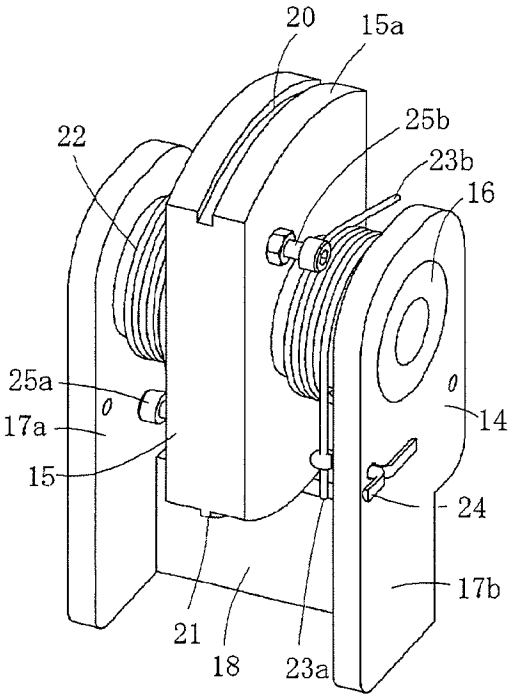

On the other hand, as shown in FIGS. 4A and 5A, when the rotatable member 15 is arranged at one standing position (the standing position at which the longitudinal end face 15*a* with the groove 20 turns up), the pin 25*b* of the rotatable member 15 moves away from the free end 23*b* of the torsion spring 23 while the pin 25*a* of the rotatable member 15 further presses the free end 22*b* of the torsion spring in the direction of twisting. Alternatively, as shown in FIGS. 4C and 5C, when the rotatable member 15 is arranged at the other standing position (the standing position at which the longitudinal end face 15*b* with the projection 21 turns up), the pin 25*a* of the rotatable member 15 moves away from the free end 22*b* of the torsion spring 22 while the pin 25*b* of the rotatable member 15 further presses the free end 23*b* of the torsion spring 23 in the direction of twisting.

Thus the rotatable member 15 which is constantly arranged at the lying position is manually rotated from the lying position to the standing position.

The positioning unit 13 is slid by a second drive mechanism 26. In this embodiment, the second drive mechanism 26 consists of a pair of pulleys 27*a*, 27*b* arranged at both ends of the slide guide 12 and rotatably attached to the frame 4, a timing belt 28 extending between the pair of pulleys 27*a*, 27*b* and parallel to the slide guide 12, and a motor 29 attached to the frame 4 and coupled to a rotary shaft of one 27*a* of the pair of pulleys 27*a*, 27*b* through an electromagnetic clutch 30.

The scoring machine 1 further has a control unit (not shown) controlling the second drive mechanism 26, a distance measurement unit measuring a travel distance of the positioning unit 13 from a reference point on the slide guide 12, and a display 32. In this embodiment, the control unit of the scoring machine 1 is included in a control unit of the buckle-type sheet folding apparatus 2. The display 32 of the scoring machine 1 can also serve as a display of the buckle-type sheet folding apparatus 2.

The distance measurement unit has a rotary encoder 31 attached to a rotary shaft of one pulley 27*a* of the second drive mechanism 26, a counter (not shown) of the control unit counting pulse signals outputted from the rotary encoder 31, and a distance calculation section (not shown) of the control unit calculating a distance based on the count value of the counter.

Figure 6:
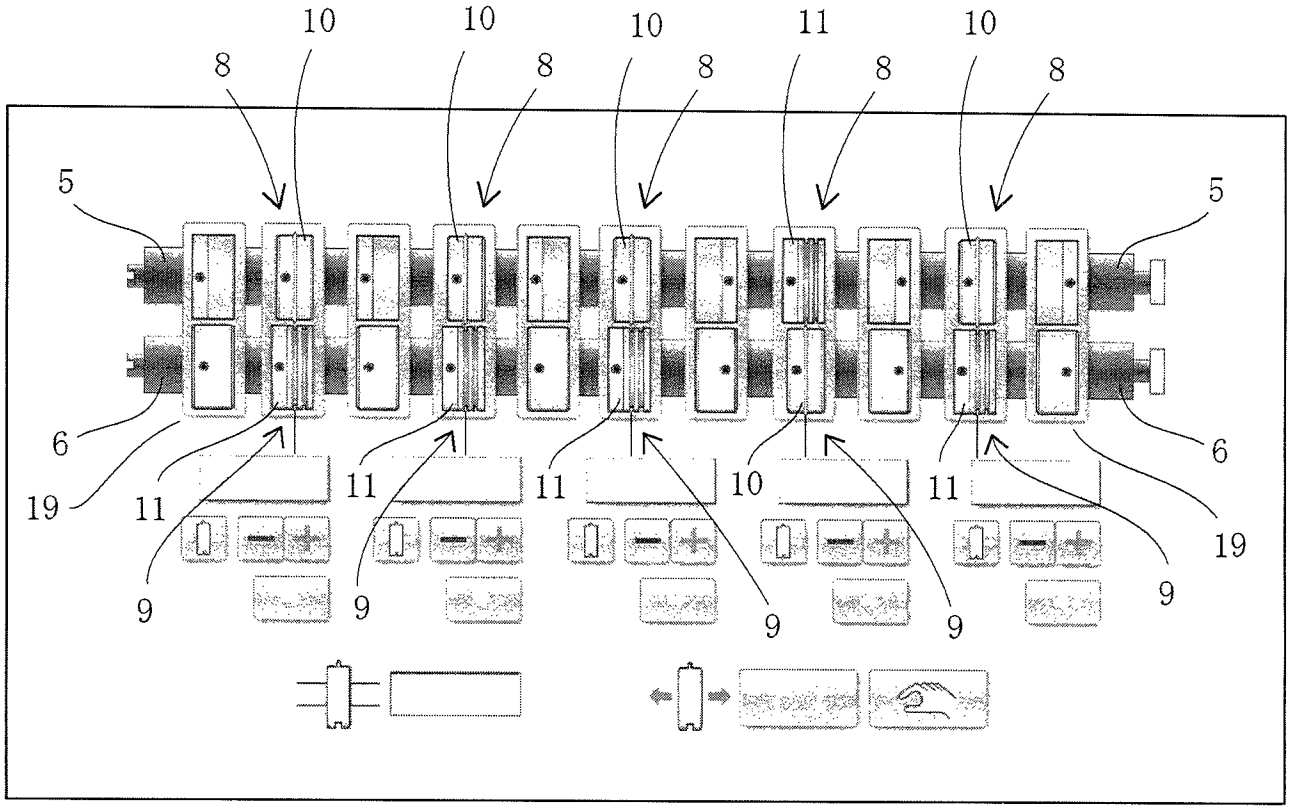
FIG. 6 is a plan view showing an example of screens displayed on a display of the scoring machine shown in FIG. 1.

FIG. 6 is a plan view showing an example of screens displayed on the display 32 when the setting of positions of the rollers of the scoring machine 1 is conducted. As shown in FIG. 6, the control unit displays on the display 32 a combination of the first and second rollers 8, 9 (a combination of the convex and concave rollers 10, 11 to be mounted on the upper and lower rotary shafts 5, 6) as well as an array of each pair of the first and second rollers on the upper and lower rotary shafts corresponding to the folding pattern. The control unit also slides the positioning unit 13 while stopping the positioning unit 13 at the specified positions of the pairs of the first and second rollers 8, 9 based on the measurement value of the distance measurement unit.

The setting of positions of the rollers of the scoring machine 1 is performed as follows. At first, an operator mounts the first and second rollers 8, 9 on the upper and lower rotary shafts 5, 6 according to the array displayed on the display, attaches the upper and lower rotary shafts 8, 9 to the frame 4 of the scoring machine 1 and starts the slide movement of the positioning unit 13. Thereafter, whenever the positioning unit 13, the operator manually rotates the rotatable member 15 from the lying position to the standing position in a manner such that the associated longitudinal end face 15*a*, 15*b* thereof faces upward depending on whether a roller to be positioned is the convex roller 10 or the concave roller 11, and positions the associated roller 10, 11 by engaging the associated roller 10, 11 with the rotatable member 15, and fixes the associated roller 10, 11 to the lower rotary shaft 6.

Furthermore, when the roller whose position has been set is the convex roller 10, the operator positions the concave roller 11 which is on the upper rotary shaft 5 and paired with the fixed convex roller 10 by engaging the annular groove 11*a* of the concave roller 11 with the annular projection 10*a* of the convex roller 10, and fixes the concave roller 11 to the upper rotary shaft 5. By contrast, when the roller whose position has been set is the concave roller 11, the operator positions the convex roller 10 which is on the upper rotary shaft 5 and paired with the fixed concave roller 11 by engaging the annular projection 10*a* of the convex roller 10 with the annular groove 11*a* of the concave roller 11, and fixes the convex roller 10 to the upper rotary shaft 5.

After the setting of positions of all of the rollers 8, 9 on the upper and lower rotary shafts 5, 6 is completed, the upper and lower rotary shafts 5, 6 are rotated and a sheet is inserted between the pairs of first and second rollers 8, 9 so as to form a score or scores on the sheet, and thereby it is checked whether the score or scores formed on the sheet agree with the folding pattern or not. Thus, according to the scoring machine 1 of the present invention, the positioning of each of the rollers is achieved easily and in a short time.

In addition, according to the scoring machine of the present invention, the positioning of all of the rollers 9 (convex and concave rollers 10, 11) on the lower rotary shaft 6 is done by using a single positioning unit 13 and therefore, a mechanism for positioning of the rollers, that is, the scoring machine can be simplified and downsized Thereby the whole of the scoring machine can be incorporated into a buckle-type sheet folding apparatus so that the downsizing of the buckle-type sheet folding apparatus is achieved.

DESCRIPTION OF REFERENCE NUMERALS

1 Scoring machine
2 Buckle-type sheet folding apparatus
3 Sheet outlet
4 Frame
5 Upper rotary shaft
6 Lower rotary shaft
7 First drive mechanism
8 First roller
8*a* Stop screw
9 Second roller
9*a* Stop screw
10 Convex roller
10*a* Annular projection
11 Concave roller
11*a* Annular groove
12 Slide guide
13 Positioning unit
14 Slider
15 Rotatable member
15*a*, 15*b* Longitudinal end face
16 Cylindrical portion
17*a*, 17*b* Wall portion
18 Connecting portion
19 Feed roller pair
20 Groove
21 Projection
22, 23 Torsion spring
22*a*, 23*a* One end
22*b*, 23*b* The other end (Free end)
24 Split pin
25*a*, 25*b* Pin
26 Second drive mechanism
27*a*, 27*b* Pulley
28 Timing belt
29 Motor
30 Electromagnetic clutch
31 Rotary encoder
32 Display

The invention claimed is:

1. A scoring machine incorporated in a buckle-type sheet folding apparatus so as to form a score or scores on sheets according to a folding pattern to be achieved by the sheet folding apparatus, the scoring machine comprising:

a frame;

upper and lower rotary shafts extending parallel with and at a distance from each other and supported by the frame to rotate about axes thereof;

a plurality of first rollers mounted on the upper rotary shaft;

a plurality of second rollers mounted on the lower rotary shaft, the first and second rollers being paired, wherein each of the first and second rollers is provided with a stop screw so that the first and second rollers are fixed to the desired position on the upper and lower rotary shafts, respectively by screwing the stop screw, and the respective paired first and second rollers are arranged opposite to each other, and one of the respective paired first and second rollers is a convex roller having an annular projection at outer periphery thereof and the other of the respective paired first and second rollers is a concave roller having an annular groove at outer periphery thereof;

a first drive mechanism attached to the frame so as to rotate the upper and lower rotary shafts in synchronization with each other, the score or scores being formed on the sheets while the sheets are passed between the respective paired first and second rollers;

a slide guide attached to the frame and extending parallel to the upper and lower rotary shafts right above the upper rotary shaft or right below the lower rotary shaft;

a single positioning unit slidably attached to the slide guide;

a second drive mechanism attached to the frame so as to move the positioning unit;

a distance measurement unit configured to measure a travel distance of the positioning unit from a reference point on the slide guide; and a display, wherein the positioning unit comprises:

a slider slidably attached to the slide guide;

a rotatable member attached to the slider so as to rotate about an axis of the slide guide between a lying position at which the rotatable member horizontally extends in a diametrical direction of the slide guide and a standing position at which the rotatable member is rotated from the lying position by 90° clockwise and counterclockwise; and a resilient biasing member arranged between the slider and the rotatable member so as to constantly bias the rotatable member toward the lying position, the rotatable member being manually rotated from the lying position to the standing position, wherein the rotatable member has longitudinal end faces each of which is in the form of a circular arc centered at the axis of the slide guide as viewed in an axial direction of the slide guide, one of the longitudinal end faces having a groove corresponding to the annular projection of the convex roller and the other of the longitudinal end faces having a projection corresponding to the annular groove of the concave roller, wherein when the rotatable member is arranged at the lying position, the positioning unit is spaced from the first or second roller of the closest rotary shaft of the upper and lower rotary shafts, and when the rotatable member is arranged at the standing position, the rotatable member is engaged with the annular projection of the convex roller of the closest rotary shaft at the groove of the longitudinal end face thereof or with the annular groove of the concave roller of the closest rotary shaft at the projection of the longitudinal end face thereof, wherein a combination of the first and second rollers as well as an array of each pair of the first and second rollers on the upper and lower rotary shafts corresponding to the folding pattern is displayed on the display, and, based on the travel distance measured by the distance measurement unit, the positioning unit stops at the specified positions of the pairs of the first and second rollers while sliding.

2. The scoring machine according to claim 1, wherein the slider of the positioning unit comprises:

a horizontal cylindrical portion;

a pair of vertical wall portions composed of plates provided with circular openings adapted to the outside diameter of the cylindrical portion and fixed to both ends of the cylindrical portion with the cylindrical portion passing through the circular openings; and a connecting portion extending between the wall portions at a distance from the axis of the cylindrical portion, the distance being larger than a half of the longitudinal length of the rotatable member, and the slider is fitted on the slide guide with the slide guide passing through the cylindrical portion, wherein the rotatable member is composed of a rectangular plate having a given amount of thickness and a central circular opening which corresponds to the outside diameter of the cylindrical portion of the slider, and fitted on the slider with the cylindrical portion passing through the central circular opening, wherein the resilient biasing member is composed of a pair of torsion springs encircling the cylindrical portion between each of the wall portions of the slider and the rotatable member, and the pair of torsion springs is arranged in such a way that directions of twisting thereof match each other, and each of the torsion springs is fixed to the associated wall portion at one end thereof and the other end of each of the torsion springs becomes a free end, and the rotatable member has pins engageable with the free ends of the associated torsion springs at side surfaces thereof opposed to the wall portions, wherein when the rotatable member is arranged at the lying position, the pins of the rotatable member press the free ends of the associated torsion springs in the direction of twisting so that the pair of torsion springs are twisted by a certain amount in the direction of twisting so as to balance between the clockwise and counterclockwise rotational moments of the rotatable member, and when the rotatable member is arranged at the standing position, one of the pins of the rotatable member moves away from the free end of the associated torsion spring and the other of the pins of the rotatable member further presses the free end of the associated torsion spring in the direction of twisting.

3. The scoring machine according to claim 1, wherein the second drive mechanism comprises:

a pair of pulleys arranged at both ends of the slide guide and rotatably attached to the frame;

a timing belt extending between the pair of pulleys and parallel to the slide guide; and a motor attached to the frame and coupled to a rotary shaft of one of the pair of pulleys, and wherein the distance measurement unit comprises:

a rotary encoder attached to a rotary shaft of one of the pair of pulleys;

a counter configured to count pulse signals outputted from the rotary encoder; and a distance calculation section configured to calculate a distance based on a count value of the counter.

* * * * *